US008153213B2

(12) United States Patent
Wu

(10) Patent No.: US 8,153,213 B2
(45) **Date of Patent: *Apr. 10, 2012**

(54) POLYIMIDE POLYSILOXANE INTERMEDIATE TRANSFER MEMBERS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 460 days.

This patent is subject to a terminal disclaimer.

(21) Appl. No.: 12/413,651

(22) Filed: Mar. 30, 2009

(65) Prior Publication Data

US 2010/0248106 A1 Sep. 30, 2010

(51) Int. Cl.
*B41M 5/50* (2006.01)
*G03G 15/16* (2006.01)

(52) U.S. Cl. ..... 428/32.51; 399/302; 428/32.12; 428/58; 428/195.1; 428/447; 428/473.5

(58) Field of Classification Search ..... 428/327–474, 428/32.12, 32.51, 58, 195.1; 399/302, 130; 430/104
See application file for complete search history.

(56) References Cited

U.S. PATENT DOCUMENTS

| | | | | |
|---|---|---|---|---|
| 5,487,707 | A | 1/1996 | Sharf et al. | |
| 5,576,818 | A * | 11/1996 | Badesha et al. | 399/308 |
| 5,922,440 | A * | 7/1999 | Schlueter et al. | 428/195.1 |
| 5,985,419 | A * | 11/1999 | Schlueter et al. | 428/195.1 |
| 6,067,430 | A * | 5/2000 | Mammino et al. | 399/174 |
| 6,318,223 | B1 | 11/2001 | Yu et al. | |
| 6,397,034 | B1 | 5/2002 | Tarnawskyj et al. | |
| 6,440,515 | B1 | 8/2002 | Thornton et al. | |
| 6,489,020 | B1 * | 12/2002 | Caruthers et al. | 428/327 |
| 6,602,156 | B2 | 8/2003 | Schlueter, Jr. | |
| 7,003,238 | B2 * | 2/2006 | Yoshida et al. | 399/66 |
| 7,031,647 | B2 | 4/2006 | Mishra et al. | |
| 7,130,569 | B2 | 10/2006 | Goodman et al. | |
| 7,139,519 | B2 | 11/2006 | Darcy, III et al. | |
| 7,910,183 | B2 * | 3/2011 | Wu | 428/32.51 |
| 2003/0143362 | A1 * | 7/2003 | Hsieh et al. | 428/58 |
| 2003/0144388 | A1 * | 7/2003 | Swift et al. | 524/79 |
| 2003/0221764 | A1 * | 12/2003 | Yu | 156/73.4 |
| 2005/0025984 | A1 * | 2/2005 | Odell et al. | 428/447 |
| 2005/0136245 | A1 * | 6/2005 | Arita et al. | 428/323 |
| 2006/0269864 | A1 * | 11/2006 | Tarnawskyj et al. | 430/124 |
| 2007/0092817 | A1 * | 4/2007 | McGuire et al. | 430/66 |
| 2009/0208258 | A1 * | 8/2009 | Aoto | 399/308 |
| 2010/0247918 | A1 | 9/2010 | Wu | |
| 2010/0247919 | A1 | 9/2010 | Wu | |
| 2010/0248102 | A1 | 9/2010 | Wu | |
| 2010/0248103 | A1 | 9/2010 | Wu | |
| 2010/0248104 | A1 | 9/2010 | Wu | |
| 2010/0248107 | A1 | 9/2010 | Wu et al. | |
| 2010/0248108 | A1 | 9/2010 | Wu et al. | |
| 2010/0249322 | A1 | 9/2010 | Wu | |

FOREIGN PATENT DOCUMENTS

JP 2006181784 A * 7/2006

OTHER PUBLICATIONS

Jin Wu, U.S. Appl. No. 12/200,074 entitled Hydrophobic Carbon Black Intermediate Transfer Components, filed Aug. 28, 2008.
Jin Wu, U.S. Appl. No. 12/200,111 entitled Hydrophobic Polyetherimide/Polysiloxane Copolymer Intermediate Transfer Components, filed Aug. 28, 2008.
Jin Wu et al., U.S. Appl. No. 12/200,147 entitled Coated Seamed Transfer Member, filed Aug. 28, 2008.
Jin Wu et al., U.S. Appl. No. 12/200,179 entitled Coated Transfer Member, filed Aug. 28, 2008.
Jin Wu, U.S. Appl. No. 12/129,995 on Polyimide Intermediate Transfer Components, filed May 30, 2008.
Jin Wu, U.S. Appl. No. 12/181,354 on Core Shell Intermediate Transfer Components, filed Jul. 29, 2008.
Jin Wu, U.S. Appl. No. 12/181,409 on Treated Carbon Black Intermediate Transfer Components, filed Jul. 29, 2008.

* cited by examiner

*Primary Examiner* — Lorna M Douyon
*Assistant Examiner* — Tri V Nguyen
(74) *Attorney, Agent, or Firm* — Oliff & Berridge, PLC

(57) ABSTRACT

An intermediate transfer media, such as a belt of a polyimide/polyetherimide/polysiloxane, a polyimide polysiloxane, a mixture of a polyimide/polyetherimide/polysiloxane and a polyimide polysiloxane, and copolymers and block copolymers thereof.

14 Claims, No Drawings

POLYIMIDE POLYSILOXANE INTERMEDIATE TRANSFER MEMBERS

CROSS REFERENCE TO RELATED APPLICATIONS

Copending U.S. application Ser. No. 12/413,627, U.S. Publication No. 20100248103, filed Mar. 30, 2009, entitled Resin Mixture Backing Layer Containing Photoconductor, the disclosure of which is totally incorporated herein by reference, illustrates a photoconductor comprising a substrate, an imaging layer thereon, and a backing layer located on a side of the substrate opposite the imaging layer wherein the outermost layer of the backing layer adjacent to the substrate is comprised of a glycoluril resin, and a polyol resin mixture.

Copending U.S. application Ser. No. 12/413,633, U.S. Publication No. 20100249322, filed Mar. 30, 2009, entitled Fluorinated Sulfonic Acid Polymer Grafted Polyaniline Containing Intermediate Transfer Members, the disclosure of which is totally incorporated herein by reference, illustrates an intermediate transfer member comprised of a substrate, and in contact therewith a polyaniline having grafted thereto a fluorinated sulfonic acid polymer.

Copending U.S. application Ser. No. 12/413,633, U.S. Publication No. 20100247918, filed Mar. 30, 2009, entitled Perfluoropolyether Polymer Grafted Polyaniline Containing Intermediate Transfer Members, the disclosure of which is totally incorporated herein by reference, illustrates an intermediate transfer member comprised of a substrate and in contact with the substrate a polyaniline grafted perfluoropolyether phosphoric acid polymer.

Copending U.S. application Ser. No. 12/413,642, U.S. Publication No. 20100247919, filed Mar. 30, 2009, entitled Fluorotelomer Grafted Polyaniline Containing Intermediate Transfer Members, the disclosure of which is totally incorporated herein by reference, illustrates An intermediate transfer member comprised of a substrate, and a layer comprised of polyaniline having grafted thereto a fluorotelomer.

Copending U.S. application Ser. No. 12/413,645, now U.S. Pat. No.7,910,183, filed Mar. 30, 2009 entitled Layered Intermediate Transfer Members, the disclosure of which is totally incorporated herein by reference, illustrates an intermediate transfer member comprised of a polyimide substrate, and thereover a polyetherimide/polysiloxane.

Copending U.S. application Ser. No. 12/413,783, U.S. Publication No. 20100248107, filed Mar. 30, 2009, entitled Glycoluril Resin And Polyol Resin Members, the disclosure of which is totally incorporated herein by reference, illustrates a process which comprises providing a flexible belt having at least one welded seam extending from one parallel edge to the other parallel edge, the welded seam having a rough seam region comprising an overlap of two opposite edges; contacting the rough seam region with a heat and pressure applying tool; and smoothing out the rough seam region with heat and pressure applied by the heat and pressure applying tool to produce a flexible belt having a smooth welded seam, and subsequently coating the seam with a resin mixture of a glycoluril resin and a polyol resin.

Copending U.S. application Ser. No. 12/413,795, U.S. Publication No. 20100248108, filed Mar. 30, 2009, entitled Glycoluril Resin And Polyol Resin Dual Members, the disclosure of which is totally incorporated herein by reference, illustrates a process which comprises providing a flexible belt having at least one welded seam extending from one parallel edge to the other parallel edge of the coating, the welded seam having a rough seam region comprising an overlap of two opposite edges; contacting the rough seam region with a heat and pressure applying tool; and smoothing out the rough seam region with heat and pressure applied by the heat and pressure applying tool, and subsequently coating the belt with a resin mixture of a glycoluril resin and a polyol resin.

Copending U.S. application Ser. No. 12/413,832, U.S. Publication No. 20100248104, filed Mar. 30, 2009, entitled Polyaniline Dialkylsulfate Complexes Containing Intermediate Transfer Members, the disclosure of which is totally incorporated herein by reference, illustrates an intermediate transfer member comprised of a polyaniline dialkylsulfate complex.

Copending U.S. application Ser. No. 12/413,852, U.S. Publication No. 20100248102, filed Mar. 30, 2009, entitled Crosslinked Resin Mixture Backing Layer Containing Photoconductor, the disclosure of which is totally incorporated herein by reference, illustrates a photoconductor comprising a substrate, an imaging layer thereon, and a backing layer located on a side of the substrate opposite the imaging layer wherein the outermost layer of the backing layer adjacent to the substrate is comprised of a mixture of glycoluril resin and a polyacetal resin mixture.

Illustrated in U.S. application Ser. No. 12/200,074, U.S. Publication No. 20100055463, entitled Hydrophobic Carbon Black Intermediate Transfer Components, filed Aug. 28, 2008, the disclosure of which is totally incorporated herein by reference, is an intermediate transfer member comprised of a substrate comprising a carbon black surface treated with a poly(fluoroalkyl acrylate).

Illustrated in U.S. application Ser. No. 12/200,111, U.S. Publication No. 20100055445, entitled Hydrophobic Polyetherimide/Polysiloxane Copolymer Intermediate Transfer Components, filed Aug. 28, 2008, is an intermediate transfer member comprised of a substrate comprising a polyetherimide polysiloxane copolymer.

Illustrated in U.S. application Ser. No. 12/200,147, U.S. Publication No. 20100055328, entitled Coated Seamed Transfer Member, filed Aug. 28, 2008, is a process which comprises providing a flexible belt having a welded seam extending from one parallel edge to the other parallel edge, the welded seam having a rough seam region comprising an overlap of two opposite edges; contacting the rough seam region with a heat and pressure applying tool; and smoothing out the rough seam region with heat and pressure applied by the heat and pressure applying tool to produce a flexible belt having a smooth welded seam, and subsequently coating the seam with a crosslinked acrylic resin.

Illustrated in U.S. application Ser. No. 12/200,179, U.S. Publication No. 20100051171, entitled Coated Transfer Member, filed Aug. 28, 2008, now U.S. Pat. No. 8,068,776, is a process which comprises providing a flexible belt having a welded seam extending from one parallel edge to the other parallel edge, the welded seam having a rough seam region comprising an overlap of two opposite edges; contacting the rough seam region with a heat and pressure applying tool; and smoothing out the rough seam region with heat and pressure applied by the heat and pressure applying tool to produce a flexible belt having a smooth welded seam, and subsequently coating the belt with a crosslinked acrylic resin.

Illustrated in U.S. application Ser. No. 12/129,995, now U.S. Pat. No. 8,005,410, filed May 30, 2008, now U.S. Pat. No. 8,005,410, entitled Polyimide Intermediate Transfer Components, the disclosure of which is totally incorporated herein by reference, is an intermediate transfer belt comprised of a substrate comprising a polyimide and a conductive component wherein the polyimide is cured at a temperature of for example, from about 175° C. to about 290° C. over a period of time of from about 10 minutes to about 120 minutes.

Illustrated in U.S. application Ser. No. 12/181,354, now U.S. Pat. No. 7,985,464, filed Jul. 29, 2008, now U.S. Pat. No. 7,985,464, entitled Core Shell Intermediate Transfer Components, the disclosure of which is totally incorporated herein by reference, is an intermediate transfer belt comprised of a substrate comprising a conductive core shell component.

Illustrated in U.S. application Ser. No. 12/181,409, now U.S. Pat. No. 7,738.824, filed Jul. 29, 2008, now U.S. Pat. No. 7,738,824, entitled Treated Carbon Black Intermediate Transfer Components, the disclosure of which is totally incorporated herein by reference, is an intermediate transfer members comprised of a substrate comprising a poly (vinylalkoxysilane) surface treated carbon black.

BACKGROUND

Disclosed are intermediate transfer members, and more specifically, intermediate transfer members useful in transferring a developed image in an electrostatographic, for example xerographic, including digital, image on image, and the like, machines or apparatuses and printers. In embodiments, there are disclosed intermediate transfer members comprised of a polyimide/polysiloxane copolymer layer, and more specifically, there is disclosed an intermediate transfer member comprised of at least one of a polyimide/polyetherimide polysiloxane block copolymer and a polyimide polysiloxane block copolymer, and where there can be included therein a conductive component.

A number of advantages are associated with the intermediate transfer members of the present disclosure, such as excellent mechanical characteristics, robustness, consistent and excellent surface resistivities, and acceptable adhesion properties especially when there is included in the intermediate transfer member an adhesive layer; excellent maintained conductivity or resistivity for extended time periods; dimensional stability; ITB humidity insensitivity for extended time periods; excellent dispersability in a polymeric solution; low and acceptable surface friction characteristics; and minimum or substantially no peeling or separation of the layers.

One specific advantage of the disclosed ITB is its low surface energy, for example, a contact angle of about 104° for the block copolymer as compared to about 71° for a similar ITB that is free of the polysiloxane as part of the polyimide polysiloxane copolymer, which advantage is of value with regard to improved toner transfer and cleaning.

In aspects thereof, the present disclosure relates to a multilayer intermediate transfer layer, such as a belt (ITB) comprising an optional base layer and a polyimide/polyetherimide polysiloxane block copolymer or polyimide polysiloxane block copolymer top layer, and where each layer further includes a conductive component, and an optional adhesive layer situated between the two layers, and which layered member can be prepared by known solution casting methods and known extrusion molded processes with the optional adhesive layer can be generated, and applied by known spray coating and flow coating processes.

Furthermore, disclosed herein is a hydrophobic intermediate transfer member having a surface resistivity of from about $10^7$ to about $10^{14}$ ohm/sq, or from about $10^9$ to about $10^{12}$ ohm/sq, and a bulk resistivity of from about $10^7$ to about $10^{14}$ ohm*cm, or from about $10^9$ to about $10^{12}$ ohm cm.

The ITB member comprised of the disclosed polyimide/polyetherimide polysiloxane block polymer or the polyimide polysiloxane block copolymer is, for example, hydrophobic, such as an about 40 percent more hydrophobic as determined by an about 30° higher contact angle as compared to an ITB that does not contain the polyimide/polyetherimide polysiloxane block polymer or the polyimide polysiloxane block copolymer. In addition, primarily because of the ITB water repelling properties determined, for example, by accelerated aging experiments at 80° F./80 percent humidity, for four weeks, the surface resistivity of the disclosed ITB members remained unchanged, while that of a similar comparative member, which is free of the polyimide/polyetherimide polysiloxane block copolymer or the polyimide polysiloxane block copolymer, varied.

In a typical electrostatographic reproducing apparatus, a light image of an original to be copied is recorded in the form of an electrostatic latent image upon a photosensitive member, and the latent image is subsequently rendered visible by the application of electroscopic thermoplastic resin particles and colorant. Generally, the electrostatic latent image is developed by contacting it with a developer mixture comprised of a dry developer mixture, which usually comprises carrier granules having toner particles adhering triboelectrically thereto, or a liquid developer material, which may include a liquid carrier having toner particles dispersed therein. The developer material is advanced into contact with the electrostatic latent image, and the toner particles are deposited thereon in image configuration. Subsequently, the developed image is transferred to a copy sheet. It is advantageous to transfer the developed image to a coated intermediate transfer web, belt, or component, and subsequently transfer with a high transfer efficiency the developed image from the intermediate transfer member to a permanent substrate. The toner image is subsequently usually fixed or fused upon a support, which may be the photosensitive member itself, or other support sheet such as plain paper.

In electrostatographic printing machines wherein the toner image is electrostatically transferred by a potential difference between the imaging member and the intermediate transfer member, the transfer of the toner particles to the intermediate transfer member and the retention thereof should be substantially complete so that the image ultimately transferred to the image receiving substrate will have a high resolution. Substantially about 100 percent toner transfer occurs when most or all of the toner particles comprising the image are transferred, and little residual toner remains on the surface from which the image was transferred.

Intermediate transfer members possess a number of advantages, such as enabling high throughput at modest process speeds; improving registration of the final color toner image in color systems using synchronous development of one or more component colors, and using one or more transfer stations; and increasing the number of substrates that can be selected. However, a disadvantage of using an intermediate transfer member is that a plurality of transfer operations is usually needed allowing for the possibility of charge exchange occurring between toner particles and the transfer member which ultimately can lead to less than complete toner transfer, resulting in low resolution images on the image receiving substrate, and image deterioration. When the image is in color, the image can additionally suffer from color shifting and color deterioration.

Attempts at controlling the resistivity of intermediate transfer members by, for example, adding conductive fillers, such as ionic additives and/or carbon black to the outer layer, are disclosed in U.S. Pat. No. 6,397,034 which describes the use of fluorinated carbon filler in a polyimide intermediate transfer member layer. However, there can be problems associated with the use of such fillers in that undissolved particles frequently bloom or migrate to the surface of the fluorinated polymer and cause imperfections to the polymer, thereby causing nonuniform resistivity, which in turn causes poor antistatic properties and poor mechanical strength characteristics. Also, ionic additives on the ITB surface may interfere with toner release. Furthermore, bubbles may appear in the polymer, some of which can only be seen with the aid of a microscope, and others of which are large enough to be observed with the naked eye resulting in poor or nonuniform electrical properties and poor mechanical properties.

In addition, the ionic additives themselves are sensitive to changes in temperature, humidity, and operating time. These sensitivities often limit the resistivity range. For example, the resistivity usually decreases by up to two orders of magnitude or more as the humidity increases from about 20 percent to 80 percent relative humidity. This effect limits the operational or process latitude.

Moreover, ion transfer can also occur in these systems. The transfer of ions leads to charge exchanges and insufficient transfers, which in turn causes low image resolution and image deterioration, thereby adversely affecting the copy quality. In color systems, additional adverse results include color shifting and color deterioration. Ion transfer also increases the resistivity of the polymer member after repetitive use. This can limit the process and operational latitude, and eventually the ion filled polymer member will be unusable.

Therefore, it is desired to provide an intermediate transfer member with a number of the advantages illustrated herein, such as excellent mechanical and humidity insensitivity characteristics permitting high copy quality where developed images with minimal resolution issues can obtained. It is also desired to provide a weldable intermediate transfer belt that may not, but could have puzzle cut seams, and instead has a weldable seam, thereby providing a belt that can be manufactured without labor intensive steps, such as manually piecing together the puzzle cut seam with fingers, and without the lengthy high temperature and high humidity conditioning steps.

A number of the known ITB formulations utilize carbon black or polyaniline as the conductive species; however, this has some limitations. For example, polyaniline is readily oxidized and results in loss of conductivity, its thermal stability is usually limited to about 200° C., and it begins to lose its conductivity at above 200° C. Also, It can be difficult to prepare carbon black based ITBs with consistent resistivity because the required loadings reside on the vertical part of the percolation curve. The amount of carbon black and how carbon black is processed (primary particle size and aggregate size) are of value for conductivity and for the manufacturing of intermediate belts.

REFERENCES

Illustrated in U.S. Pat. No. 7,031,647 is an imageable seamed belt containing a lignin sulfonic acid doped polyaniline.

Illustrated in U.S. Pat. No. 7,139,519 is an intermediate transfer belt, comprising a belt substrate comprising primarily at least one polyimide polymer; and a welded seam.

Illustrated in U.S. Pat. No. 7,130,569 is a weldable intermediate transfer belt comprising a substrate comprising a homogeneous composition comprising a polyaniline in an amount of, for example, from about 2 to about 25 percent by weight of total solids, and a thermoplastic polyimide present in an amount of from about 75 to about 98 percent by weight of total solids, wherein the polyaniline has a particle size of, for example, from about 0.5 to about 5 microns.

Puzzle cut seam members are disclosed in U.S. Pat. Nos. 5,487,707; 6,318,223, and 6,440,515.

Illustrated in U.S. Pat. No. 6,602,156 is a polyaniline filled polyimide puzzle cut seamed belt, however, the manufacture of a puzzle cut seamed belt is labor intensive and costly, and the puzzle cut seam, in embodiments, is sometimes weak. The manufacturing process for a puzzle cut seamed belt usually involves a lengthy in time high temperature and high humidity conditioning step. For the conditioning step, each individual belt is rough cut, rolled up, and placed in a conditioning chamber that is environmentally controlled at about 45° C. and about 85 percent relative humidity, for approximately 20 hours. To prevent or minimize condensation and watermarks, the puzzle cut seamed transfer belt resulting is permitted to remain in the conditioning chamber for a suitable period of time, such as 3 hours. The conditioning of the transfer belt renders it difficult to automate the manufacturing thereof, and the absence of such conditioning may adversely impact the belts electrical properties, which in turn results in poor image quality.

SUMMARY

In embodiments, there is disclosed an intermediate transfer member comprised of at least one of a polyimide/polyetherimide/polysiloxane and a polyimide polysiloxane; an intermediate transfer member comprised of a polyimide/polyetherimide polysiloxane block copolymer, or a random block copolymer of polyimide and polyetherimide; a transfer media comprised of first substrate layer, and thereover a second layer comprised of a polyimide/polyetherimide polysiloxane block copolymer; an adhesive layer situated between the first layer and the second layer, and wherein at least one of the first layer and the second layer further contains a conductive component like carbon black, polyaniline, and other known conductive materials; a transfer media comprised of a first substrate layer, and thereover a second layer comprised of a polyimide polysiloxane block copolymer; an adhesive layer situated between the first layer and the second layer, and wherein at least one of the first layer and the second layer further includes a conductive component as illustrated herein; an apparatus for forming images on a recording medium comprising a charge retentive surface to receive an electrostatic latent image thereon; a development component to apply toner to the charge retentive surface to develop the electrostatic latent image, and to form a developed image on the charge retentive surface; and an intermediate transfer media that functions to transfer the developed image from the charge retentive surface to a substrate, wherein the intermediate transfer media is comprised of a polyimide substrate, and in contact with the substrate at least one of a polyimide/polyetherimide polysiloxane block copolymer and a polyimide polysiloxane block copolymer; an intermediate transfer member where the polyimide/polyetherimide polysiloxane block copolymer is prepared by reacting an ether free anhydride/carboxylic acid, an ether anhydride/carboxylic acid, an ether free amine, and an amino terminated polysiloxane, or an ether free anhydride/carboxylic acid, an ether free amine, an ether amine, and an amino terminated polysiloxane, or reacting an ether anhydride/carboxylic acid, an ether free anhydride/carboxylic acid, an ether free amine, an ether amine, and an amino terminated polysiloxane; an intermediate transfer member where the polyimide polysiloxane block copolymer is prepared by reacting an ether free anhydride/carboxylic acid, an ether free amine, and an amino terminated polysiloxane; an intermediate transfer member, such as an intermediate belt, comprised of a substrate comprising, for example, an optional polyimide, and thereover a layer comprised of a polyimide/polyetherimide/polysiloxane polymer like a polyimide/polyetherimide polysiloxane block polymer, a polyimide polysiloxane block polymer, or mixtures thereof. Furthermore, there is disclosed an intermediate transfer member comprised of an optional polyimide supporting substrate, a polyimide/polyetherimide polysiloxane block copolymer layer thereover, or a polyimide polysiloxane block copolymer layer thereover, and where each layer further contains a conductive component such as a polyaniline, carbon black, and the like.

In specific embodiments, there are provided transfer members such as intermediate transfer belts inclusive of an intermediate transfer member comprised of at least one of a polyimide/polyetherimide/polysiloxane, and a polyimide polysiloxane; a transfer media comprised of a first substrate layer, and thereover a second layer comprised of a polyimide/polyetherimide polysiloxane block copolymer; an adhesive layer situated between the first layer and the second layer, and wherein at least one of the first layer and the second layer further contains a conductive component; a transfer media comprised of a first substrate layer and thereover a second layer comprised of a polyimide polysiloxane block copolymer; an adhesive layer situated between the first layer and the second layer, and wherein at least one of the first layer and the second layer further contains a conductive component; an apparatus for forming images on a recording medium comprising a charge retentive surface to receive an electrostatic latent image thereon; a development component to apply toner to the charge retentive surface to develop the electrostatic latent image, and to form a developed image on the charge retentive surface; and an intermediate transfer media that functions to transfer the developed image from the charge retentive surface to a substrate, wherein the intermediate transfer media is comprised of a polyimide substrate, and in contact with the substrate at least one of a polyimide/polyetherimide polysiloxane block copolymer and a polyimide polysiloxane block copolymer.

In addition, the present disclosure provides, in embodiments, an apparatus for forming images on a recording medium comprising a charge retentive surface to receive an electrostatic latent image thereon; a development component to apply toner to the charge retentive surface to develop the electrostatic latent image, and to form a developed image on the charge retentive surface; a weldable intermediate transfer belt to transfer the developed image from the charge retentive surface to a substrate, and a fixing component.

In embodiments, there is selected for the intermediate transfer member illustrated herein a polyimide/polyetherimide polysiloxane block copolymer where the polyimide/polyetherimide block is a random copolymer of polyimide and polyetherimide, and the weight percent of the polyimide within the polyimide/polyetherimide block is from about 1 to about 99, or from about 30 to about 70, and which polyimide/polysiloxane block copolymer can be prepared by reacting an anhydride or a carboxylic acid with an amine, and an amino terminated polysiloxane. The weight average molecular weight ($M_w$) of the block copolymer can vary, and can be, for example, from about 5,000 to about 1,000,000, from about 20,000 to about 500,000, from about 50,000 to about 300,000, from about 75,000 to about 175,000, and the like; and wherein the weight percent of the polysiloxane block in the block copolymer is, for example, from about 5 to about 95, from about 10 to about 75, from about 15 to about 50, from about 20 to about 40, and other suitable percentages, and wherein the total of the components in the copolymer is about 100 percent.

Examples of the polyimide/polyetherimide block of the polyimide/polyetherimide polysiloxane block copolymer can be prepared from imidization of an ether free carboxylic acid or anhydride selected from one of biphenyltetracarboxylic acid, pyromellitic acid, pyromellitic dianhydride, and benzophenone tetracarboxylic dianhydride, an ether carboxylic acid or anhydride selected from 2,2-bis(2,3-dicarboxyphenoxyphenol)propane dianhydride, and an ether free amine selected from one of metaphenyldiamine and p-phenylenediamine.

Examples of the polyimide/polyetherimide block of the polyimide/polyetherimide polysiloxane block copolymer can also be prepared from imidization of an ether free carboxylic acid or anhydride selected from one of biphenyltetracarboxylic acid, pyromellitic acid, pyromellitic dianhydride, and benzophenone tetracarboxylic dianhydride; an ether free amine selected from one of metaphenyldiamine and p-phenylenediamine, and an ether amine selected from one of 4,4-oxydianiline, diaminodiphenylether and 2,2-bis[4-(8-aminophenoxy)phenoxy]-hexafluoropropane.

Examples of the polyimide/polyetherimide block of the polyimide/polyetherimide polysiloxane block copolymer can also be prepared from imidization of an ether free carboxylic acid or anhydride selected from one of biphenyltetracarboxylic acid, pyromellitic acid, pyromellitic dianhydride, and benzophenone tetracarboxylic dianhydride, an ether carboxylic acid or anhydride selected from 2,2-bis(2,3-dicarboxyphenoxyphenol)propane dianhydride, an ether free amine selected from one of metaphenyldiamine and p-phenylenediamine, and an ether amine selected from one of 4,4-oxydianiline, diaminodiphenylether and 2,2-bis[4-(8-aminophenoxy)phenoxy]-hexafluoropropane.

Examples of the polyimide block of the polyimide polysiloxane block copolymer can be prepared from imidization of an ether free carboxylic acid, or anhydride selected from one of biphenyltetracarboxylic acid, pyromellitic acid, pyromellitic dianhydride, and benzophenone tetracarboxylic dianhydride, and an ether free amine selected from one of metaphenyldiamine and p-phenylenediamine.

Examples of the polysiloxane block of the polyimide/polyetherimide polysiloxane block copolymer, and the polyimide polysiloxane block copolymer are D10 polydimethylsiloxane.

Examples of the first layer or substrate layer are, for example, thermoplastic polyimides like KAPTON® KJ, commercially available from E.I. DuPont, Wilmington, Del., as represented by

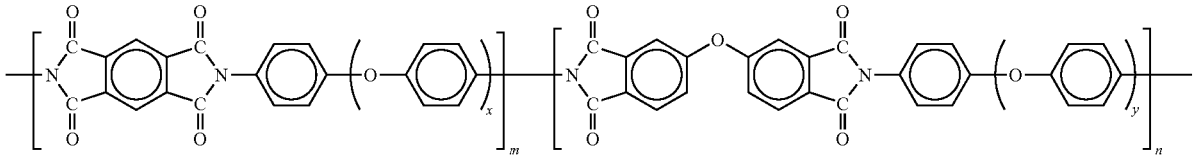

wherein x is equal to 2; y is equal to 2; m and n are from about 10 to about 300; and IMIDEX®, commercially available from West Lake Plastic Company, as represented by

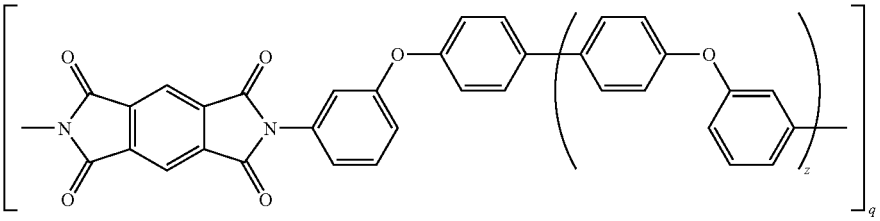

wherein z is equal to 1, and q is from about 10 to about 300.

The thermosetting polyimides selected as the first layer are cured, for example, at suitable temperatures, and more specifically, from about 180° C. to about 260° C. over a short period of time, such as, for example, from about 10 to about 120, and from about 20 to about 60 minutes; possess, for example, a number average molecular weight of from about 5,000 to about 500,000, or from about 10,000 to about 100,000, and a weight average molecular weight of from about 50,000 to about 5,000,000, or from about 100,000 to about 1,000,000; thermosetting polyimide precursors that are cured at higher temperatures (above 300° C.) than the VTEC™ PI polyimide precursors, and which precursors include, for example, PYRE-M.L® RC-5019. RC-5057, RC-5069, RC-5097, RC-5053, and RK-692, all commercially available from Industrial Summit Technology Corporation, Parlin, N.J.; RP-46 and RP-50, both commercially available from Unitech LLC, Hampton, Va.; DURIMIDE® 100, commercially available from FUJIFILM Electronic Materials U.S.A., Inc., North Kingstown, R.I.; and KAPTON® HN, VN, and FN, commercially available from E.I. DuPont, Wilmington, Del., in amounts of, for example, of from about 70 to about 97, or from about 80 to about 95 weight percent of the intermediate transfer member.

Examples of thermosetting polyimides that can be incorporated into the first layer of the intermediate transfer member include low temperature and rapidly cured polyimide polymers, such as VTEC™ PI 1388, 080-051, 851, 302, 203, 201 and PETI-5, all available from Richard Blaine International, Incorporated, Reading, Pa. These thermosetting polyimides can be cured at temperatures of from about 180° C. to about 260° C. over a short period of time, such as from about 10 to about 120 minutes, or from about 20 to about 60 minutes; possess a number average molecular weight of from about 5,000 to about 500,000, or from about 10,000 to about 100,000, and a weight average molecular weight of from about 50,000 to about 5,000,000, or from about 100,000 to about 1,000,000. Other thermosetting polyimides that can be selected for the ITM or ITB, and cured at temperatures of above 300° C. include PYRE M.L® RC-5019, RC 5057, RC-5069, RC-5097, RC-5053, and RK-692, all commercially available from Industrial Summit Technology Corporation, Parlin, N.J.; RP-46 and RP-50, both commercially available from Unitech LLC, Hampton, Va.; DURIMIDE® 100 commercially available from FUJIFILM Electronic Materials U.S.A., Inc., North Kingstown, R.I.; and KAPTON® HN, VN and FN, all commercially available from E.I. DuPont, Wilmington, Del.

Other suitable polyimides include those formed from various diamines and dianhydrides, such as poly(amidimide), polyetherimide, polysiloxane polyetherimide block copolymer, and the like. Preferred polyimides include aromatic polyimides, such as those formed by the reacting pyromellitic acid and diaminodiphenylether, or by imidization of copolymeric acids, such as biphenyltetracarboxylic acid and pyromellitic acid with two aromatic diamines, such as p-phenylenediamine and diaminodiphenylether. Another suitable polyimide includes pyromellitic dianhydride and benzophenone tetracarboxylic dianhydride copolymeric acids reacted with 2,2-bis[4-(8-aminophenoxy)phenoxy]-hexafluoropropane. Other suitable aromatic polyimides include those containing 1,2,1',2'-biphenyltetracarboximide and para-phenylene groups, and those having biphenyltetracarboximide functionality with diphenylether end spacer characterizations. Mixtures of polyimides can also be used.

The conductive material, such as a carbon black or polyaniline, is present in at least one layer of the intermediate transfer member in, for example, an amount of from about 1 to about 30 weight percent, from about 3 to about 20 weight percent, or preferably from about 5 to about 15 weight percent.

Carbon black surface groups can be formed by oxidation with an acid or with ozone, and where there is absorbed or chemisorbed oxygen groups from, for example, carboxylates, phenols, and the like. The carbon surface is essentially inert to most organic reaction chemistry except primarily for oxidative processes and free radical reactions.

The conductivity of carbon black is dependent on surface area and its structure primarily. Generally, the higher surface area and the higher structure, the more conductive the carbon black. Surface area is measured by the B.E.T. nitrogen surface area per unit weight of carbon black, and is the measurement of the primary particle size. Structure is a complex property that refers to the morphology of the primary aggregates of carbon black. It is a measure of both the number of primary particles comprising primary aggregates, and the manner in which they are "fused" together. High structure carbon blacks are characterized by aggregates comprised of many primary particles with considerable "branching" and "chaining", while low structure carbon blacks are characterized by compact aggregates comprised of fewer primary particles. Structure is measured by dibutyl phthalate (DBP) absorption by the voids within carbon blacks. The higher the structure, the more the voids, and the higher the DBP absorption.

Examples of carbon blacks selected as the conductive component include VULCAN® carbon blacks, REGAL® carbon blacks, BLACK PEARLS® carbon blacks available from Cabot Corporation. Specific examples of conductive carbon blacks are BLACK PEARLS® 1000 (B.E.T. surface area=343 $m^2/g$, DBP absorption=105 ml/g), BLACK PEARLS® 880 (B.E.T. surface area=240 $m^2/g$, DBP absorption=106 ml/g), BLACK PEARLS® 800 (B.E.T. surface area=230 $m^2/g$, DBP absorption=68 ml/g), BLACK PEARLS® L (B.E.T. surface area=138 $m^2/g$, DBP absorption=61 ml/g), BLACK PEARLS® 570 (B.E.T. surface area=110 $m^2/g$, DBP absorption=114 ml/g), BLACK PEARLS® 170 (B.E.T. surface area=35 $m^2/g$, DBP absorption=122 ml/g), VULCAN® XC72 (B.E.T. surface area=254 $m^2/g$, DBP absorption=176 ml/g), VULCAN® XC72R (fluffy form of VULCAN® XC72), VULCAN® XC605, VULCAN® XC305, REGAL® 660 (B.E.T. surface area=112 $m^2/g$, DBP absorption=59 ml/g), REGAL® 400 (B.E.T. surface area=96 $m^2/g$, DBP absorption=69 ml/g), and REGAL®330 (B.E.T. surface area=94 $m^2/g$, DBP absorption=71 ml/g).

In embodiments, the selected polyaniline conductive component has a relatively small particle size of from about 0.5 to about 5, from about 1.1 to about 2.3, from about 1.2 to about 2, from about 1.5 to about 1.9, or about 1.7 microns. Specific examples of polyanilines selected for the transfer member, such as an ITB, are PANIPOL™ F, commercially available from Panipol Oy, Finland.

As illustrated herein, the carbon black or polyaniline is usually formed into a dispersion, such as a blend of the polyimide/polyetherimide/polysiloxane polymer or the polyimide polysiloxane polymer. With proper milling processes, uniform dispersions can be obtained, and the dispersion can be applied to or coated on a biaxially oriented poly(ethylene naphthalate) (PEN) substrate (KALEDEX™ 2000) having a thickness of 3.5 mils using known draw bar coating methods. The resulting film or films can be dried at high temperatures, such as from about 100° C. to about 200° C., or from about 120° C. to about 160° C. for a sufficient period of time, such as for example, from about 1 to about 30, or from about 5 to about 15 minutes while remaining on the PEN substrate. After drying and cooling to room temperature, about 23° C. to about 25° C., the film or films on the PEN substrate or separate PEN substrates are automatically released from the substrate resulting in the functional intermediate transfer member or members as disclosed herein.

Adhesive layer components, and which layer is usually situated between a supporting substrate and the polyimide/polyetherimide polysiloxane block copolymer, or the polyimide polysiloxane block copolymer thereover are a number of epoxy, urethane, silicone, polyester and the like. Generally the adhesive layer is a solventless layer that is materials that are liquid at room temperature (about 25° C.) and are able to crosslink to an elastic or rigid film to adhere at least two materials together. Specific examples include 100 percent solids adhesives including polyurethane adhesives from Lord Corporation, Erie, Pa., such as TYCEL® 7924 (viscosity from about 1,400 to about 2,000 cps), TYCEL® 7975 (viscosity from about 1,200 to about 1,600 cps) and TYCEL® 7276. The viscosity range of the adhesives is from about 1,200 to about 2,000 cps. The solventless adhesives can be activated with either heat, room temperature curing, moisture curing, ultraviolet radiation, infrared radiation, electron beam curing, or any other known technique. The thickness of the adhesive layer is usually less than 100 nanometers, and more specifically, as illustrated hereinafter.

The thickness of each layer, when two layers are present, of the intermediate transfer member can vary and is not limited to any specific value. In specific embodiments, the optional substrate layer thickness is, for example, from about 20 to about 300, from about 30 to about 200, from about 75 to about 150, and from about 50 to about 100 microns, while the thickness of the polyimide/polyetherimide polysiloxane block copolymer layer or the polyimide polysiloxane block copolymer layer is, for example, from about 1 to about 300 microns, from about 2 to about 140 microns, from about 3 to about 80 microns, or from about 10 to about 30 microns. The adhesive layer thickness is from, for example, from about 1 to about 100 nanometers, from about 5 to about 75 nanometers, or from about 50 to about 100 nanometers.

The disclosed intermediate transfer members are, in embodiments, weldable, that is the seam of the member like a belt is weldable, and more specifically, may be ultrasonically welded to produce a seam. The surface resistivity of the disclosed intermediate transfer member is, for example, from about $10^9$ to about $10^{13}$ ohm/sq, or from about $10^{10}$ to about $10^{12}$ ohm/sq. The sheet resistivity of the intermediate transfer weldable member is, for example, from about $10^9$ to about $10^{13}$ ohm/sq, or from about $10^{10}$ to about $10^{12}$ ohm/sq.

The intermediate transfer members illustrated herein like intermediate transfer belts can be selected for a number of printing, and copying systems, inclusive of xerographic printing. For example, the disclosed intermediate transfer members can be incorporated into a multi-imaging system where each image being transferred is formed on the imaging or photoconductive drum at an image forming station, wherein each of these images is then developed at a developing station, and transferred to the intermediate transfer member. The images may be formed on the photoconductor and developed sequentially, and then transferred to the intermediate transfer member. In an alternative method, each image may be formed on the photoconductor or photoreceptor drum, developed, and transferred in registration to the intermediate transfer member. In an embodiment, the multi-image system is a color copying system, wherein each color of an image being copied is formed on the photoreceptor drum, developed, and transferred to the intermediate transfer member.

After the toner latent image has been transferred from the photoreceptor drum to the intermediate transfer member, the intermediate transfer member may be contacted under heat and pressure with an image receiving substrate such as paper. The toner image on the intermediate transfer member is then transferred and fixed, in image configuration, to the substrate such as paper.

The intermediate transfer member present in the imaging systems illustrated herein, and other known imaging and printing systems, may be in the configuration of a sheet, a web, a belt, including an endless belt, an endless seamed flexible belt, and an endless seamed flexible belt; a roller, a film, a foil, a strip, a coil, a cylinder, a drum, an endless strip, and a circular disc. The intermediate transfer member can be comprised of a single layer, or it can be comprised of several layers, such as from about 2 to about 5 layers. In embodiments, the intermediate transfer member further includes an outer release layer.

Release layer examples situated on and in contact with the second layer include low surface energy materials, such as TEFLON®-like materials including fluorinated ethylene propylene copolymer (FEP), polytetrafluoroethylene (PTFE), polyfluoroalkoxy polytetrafluoroethylene (PFA TEFLON®), and other TEFLON®-like materials; silicone materials such as fluorosilicones and silicone rubbers such as Silicone Rubber 552, available from Sampson Coatings, Richmond, Va., (polydimethyl siloxane/dibutyl tin diacetate, 0.45 gram DBTDA per 100 grams polydimethyl siloxane rubber mixture with a molecular weight $M_w$ of approximately 3,500); and fluoroelastomers such as those sold as VITON®, such as copolymers and terpolymers of vinylidenefluoride, hexafluoropropylene and tetrafluoroethylene, which are known commercially under various designations as VITON A®, VITON E®, VITON E60C®, VITON E45®, VITON E430®, VITON B910®, VITON GH®, VITON B50®, VITON E45®, and VITON GF®. The VITON® designation is a Trademark of E.I. DuPont de Nemours, Inc. Two known fluoroelastomers are comprised of (1) a class of copolymers of vinylidenefluoride, hexafluoropropylene, and tetrafluoroethylene, known commercially as VITON A®, (2) a class of terpolymers of vinylidenefluoride, hexafluoropropylene, and tetrafluoroethylene known commercially as VITON B®, and (3) a class of tetrapolymers of vinylidenefluoride, hexafluoropropylene, tetrafluoroethylene, and a cure site monomer, such as VITON GF®, having 35 mole percent of vinylidenefluoride, 34 mole percent of hexafluoropropylene, and 29 mole percent of tetrafluoroethylene with 2 percent cure site monomer. The cure site monomer can be those available from DuPont such as 4-bromoperfluorobutene-1, 1,1-dihydro-4-bromoperfluorobutene-1, 3-bromoperfluoropropene-1, 1,1-dihydro-3-bromoperfluoropropene-1, or any other suitable known, commercially available cure site monomer.

The layer or layers may be deposited on the substrate via well known coating processes. Known methods for forming the outer layer(s) on the substrate film, such as dipping, spraying such as by multiple spray applications of very thin films, casting, flow-coating, web-coating, roll-coating, extrusion, molding, or the like, can be used. It is preferred to deposit the layers by spraying such as by multiple spray applications of very thin films, casting, by web coating, by flow-coating, and most preferably by laminating.

The circumference of the intermediate transfer member, especially as it is applicable to a film or a belt configuration, is, for example, from about 250 to about 2,500 millimeters, from about 1,500 to about 3,000 millimeters, or from about 2,000 to about 2,200 millimeters with a corresponding width of, for example, from about 100 to about 1,000 millimeters, from about 200 to about 500 millimeters, or from about 300 to about 400 millimeters.

Specific embodiments will now be described in detail. These examples are intended to be illustrative, and are not limited to the materials, conditions, or process parameters set forth in these embodiments. All parts are percentages by weight of total solids unless otherwise indicated.

EXAMPLE I

A one-layer polyimide/polyetherimide polysiloxane block copolymer intermediate transfer belt (ITB) member is prepared as follows.

One gram of PANIPOL® F, a hydrochloric acid doped emeraldine salt obtained from Panipol Oy (Porvoo Finland), is mixed with 9 grams of a polyimide/polyetherimide polysiloxane block copolymer prepared from reacting 2,2-bis(2,3-dicarboxyphenoxyphenol)propane dianhydride (0.30 mol), pyromellitic dianhydride (0.05 mol), p-phenylenediamine (0.35 mol), an aminopropyl terminated D10 polydimethylsiloxane (0.30 mol), and 100 grams of methylene chloride. By ball milling this mixture with 2 millimeter stainless shot overnight, or 23 hours, a uniform dispersion is obtained. The dispersion is then coated on a biaxially oriented poly(ethylene naphthalate) (PEN) substrate (KALEDEX™ 2000) having a thickness of 3.5 mils using known draw bar coating methods. The resulting film is dried at about 120° C. for 1 minute while remaining on the PEN substrate. After drying and cooling to room temperature, about 23° C. to about 25° C., the film on the PEN substrate is automatically released from the substrate resulting in a 50 micron thick intermediate transfer member of polyaniline/polyimide/polyetherimide polysiloxane block copolymer with a ratio by weight of 10/90, polyaniline/polyimide/polyetherimide polysiloxane.

EXAMPLE II

A one-layer polyimide polysiloxane block copolymer intermediate transfer belt (ITB) member is prepared as follows.

One gram of PANIPOL® F, a hydrochloric acid doped emeraldine salt obtained from Panipol Oy (Porvoo Finland), is mixed with 9 grams of a polyimide polysiloxane block copolymer prepared from reacting pyromellitic dianhydride (0.35 mol), metaphenyldiamine (0.35 mol), an aminopropyl terminated D10 polydimethylsiloxane (0.30 mol), and 100 grams of methylene chloride. By ball milling this mixture with 2 millimeter stainless shot overnight, or 23 hours, a uniform dispersion is obtained. The dispersion is then coated on a biaxially oriented poly(ethylene naphthalate) (PEN) substrate (KALEDEX™ 2000) having a thickness of 3.5 mils using known draw bar coating methods. The resulting film is dried at about 120° C. for 1 minute while remaining on the PEN substrate. After drying and cooling to room temperature, about 23° C. to about 25° C., the film on the PEN substrate is automatically released from the substrate resulting in a 50 micron thick intermediate transfer member of polyaniline/polyimide polysiloxane block copolymer with a ratio by weight of 10/90.

EXAMPLE III

A two-layer intermediate transfer belt (ITB) member with a polyimide base layer and a polyimide/polyetherimide polysiloxane block copolymer top layer is prepared as follows.

One gram of PANIPOL® F, a hydrochloric acid doped emeraldine salt obtained from Panipol Oy (Porvoo Finland), is mixed with 28.3 grams of the polyamic acid solution, VTEC™ PI 1388 (polyimide, 20 weight percent solids in NMP, obtained from Richard Blaine International, Incorporated). By ball milling this mixture with 2 millimeter stainless shot via an Attritor for 2 hours, a uniform dispersion is obtained. The dispersion is then coated on a glass plate using a draw bar coating method. Subsequently, the film obtained is dried at 100° C. for 20 minutes, and then 204° C. for an additional 20 minutes while remaining on the glass plate.

Subsequently, one gram of PANIPOL® F, a hydrochloric acid doped emeraldine salt obtained from Panipol Oy (Porvoo Finland), is mixed with 9 grams of a polyimide/polyetherimide polysiloxane block copolymer prepared from reacting 2,2-bis(2,3-dicarboxyphenoxyphenol)propane dianhydride (0.30 mol), pyromellitic dianhydride (0.05 mol), p-phenylenediamine (0.35 mol), an aminopropyl terminated D10 polydimethylsiloxane (0.30 mol), and 100 grams of methylene chloride. By ball milling this mixture with 2 millimeter stainless shot overnight, or 23 hours, a uniform dispersion is obtained. The resulting dispersion inclusive of the polyimide/polyetherimide polysiloxane block copolymer is then coated on the above polyaniline/polyimide base layer on the glass plate, and dried at 120° C. for 5 minutes.

The two-layer film on the glass is then immersed into water overnight, about 23 hours, and the freestanding film is released from the glass automatically resulting in a two-layer intermediate transfer member with a 80 micron thick polyaniline/polyimide base layer with a ratio by weight of 15 polyaniline, 85 polyimide, and a 20 micron polyimide/polyetherimide polysiloxane block copolymer top layer with a ratio by weight of 10 polyaniline and 90 polyimide/polyetherimide polysiloxane block copolymer.

EXAMPLE IV

A two-layer intermediate transfer belt (ITB) member with a polyimide base layer and a polyimide polysiloxane block copolymer top layer is prepared as follows.

One gram of PANIPOL® F, a hydrochloric acid doped emeraldine salt obtained from Panipol Oy (Porvoo Finland), is mixed with 28.3 grams of the polyamic acid solution, VTEC™ PI 1388 (polyimide, 20 weight percent solids in NMP, obtained from Richard Blaine International, Incorporated). By ball milling this mixture with 2 millimeter stainless shot with an Attritor for 2 hours, a uniform dispersion is obtained. The dispersion is then coated on a glass plate using a draw bar coating method. Subsequently, the film obtained is dried at 100° C. for 20 minutes, and then 204° C. for an additional 20 minutes while remaining on the glass plate.

Thereafter, one gram of PANIPOL® F, a hydrochloric acid doped emeraldine salt obtained from Panipol Oy (Porvoo Finland), is mixed with 9 grams of a polyimide polysiloxane block copolymer prepared from reacting pyromellitic dianhydride (0.35 mol), metaphenyldiamine (0.35 mol) and an aminopropyl terminated D10 polydimethylsiloxane (0.30 mol), and 100 grams of methylene chloride. By ball milling this mixture with 2 millimeter stainless shot overnight, or 23 hours, a uniform dispersion is obtained. The resulting dispersion inclusive of the polyimide polysiloxane block copolymer is then coated on the above polyaniline/polyimide base layer on the glass plate, and dried at 120° C. for 5 minutes.

The two-layer film on the glass is then immersed into water overnight, about 23 hours, and the freestanding film is released from the glass automatically resulting in a two-layer intermediate transfer member with a 80 micron thick polyaniline/polyimide base layer with a ratio by weight of 15 polyaniline, 85 polyimide, and a 20 micron polyimide polysiloxane block copolymer top layer with a ratio by weight of 10 polyaniline and 90 polyimide polysiloxane block copolymer.

EXAMPLE V

A three-layer intermediate transfer belt (ITB) member with a polyimide base layer, a solventless adhesive layer, and a polyimide/polyetherimide polysiloxane block copolymer top layer is prepared by repeating the process of Example III except that a solventless adhesive layer is incorporated between the polyimide base layer and the polyimide/polyetherimide polysiloxane block copolymer top layer.

The solventless adhesive, TYCEL® 7975-A (adhesive) and 7276 (curing agent) both from Lord Corporation, Erie, Pa., applied on the base layer via spray coating, and then the top layer is coated as described in Example III.

The resulting three-layer film on the glass substrate is then immersed into water overnight, about 23 hours, and the freestanding film is released from the glass automatically resulting in a three-layer intermediate transfer member with a 80 micron polyaniline/polyimide base layer with a ratio by weight of 15/85; a 100 nanometer thick adhesive layer; and a 20 micron thick polyaniline/polyimide/polyetherimide polysiloxane block copolymer top layer with a ratio by weight of 10/90.

EXAMPLE VI

A three-layer intermediate transfer belt (ITB) member with a polyimide base layer, a solventless adhesive layer, and a polyimide polysiloxane block copolymer top layer is prepared by repeating the process of Example IV except that a solventless adhesive layer is incorporated between the polyimide base layer, and the polyimide polysiloxane block copolymer top layer.

The solventless adhesive, TYCEL® 7975-A (adhesive) and 7276 (curing agent) both from Lord Corporation, Erie, Pa., applied on the base layer via spray coating, and then the top layer is coated as described in Example IV.

The resulting three-layer film on the glass substrate is then immersed into water overnight, about 23 hours, and the freestanding film is released from the glass automatically resulting in a three-layer intermediate transfer member with a 80 micron polyaniline/polyimide base layer with a ratio by weight of 15/85; a 100 nanometer thick adhesive layer; and a 20 micron thick polyaniline/polyimide polysiloxane block copolymer top layer with a ratio by weight of 10/90.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An intermediate transfer member consisting of a supporting substrate, a polymer layer consisting of a polyimide polysiloxane that possesses a weight average molecular weight of from about 20,000 to about 300,000, a conductive component of a polyaniline present in an amount of from about 1 to about 40 percent by weight based on the weight of total solids, a polymer selected from the group consisting of a polycarbonate, a polyamidimide, a polyphenylene sulfide, a polyamide, a polysulfone, a polyester, a polyvinylidene fluoride, a polyethylene-co-polytetrafluoroethylene, and mixtures thereof present in an amount of from about 70 to about 90 weight percent based on the weight of total solids and an outer release layer positioned on said polymer layer, wherein said release layer is selected from the group consisting of a poly(vinyl chloride), a fluorinated ethylene propylene copolymer, a polytetrafluoroethylene, a polyfluoroalkoxy polytetrafluoroethylene, a fluorosilicone, a copolymer or terpolymer of vinylidenefluoride, hexafluoropropylene and tetrafluoroethylene, and mixtures thereof and an optional adhesive layer situated between the substrate and the outer release layer.

2. An intermediate transfer member in accordance with claim 1 wherein said polyimide polysiloxane is a polyimide polysiloxane block copolymer.

3. An intermediate transfer member in accordance with claim 1 wherein said polyimide polysiloxane is prepared by reacting an ether free anhydride/carboxylic acid, an ether free amine, and an amino terminated polysiloxane.

4. An intermediate transfer member in accordance with claim 3 wherein said ether free anhydride/carboxylic acid is selected from the group consisting of biphenyltetracarboxylic acid, pyromellitic acid, pyromellitic dianhydride, and benzophenone tetracarboxylic dianhydride, said ether free amine is metaphenyldiamine, or p-phenylenediamine, and said polysiloxane is a polydimethylsiloxane.

5. An intermediate transfer member in accordance with claim 1 wherein said polysiloxane is present in an amount of from about 5 to about 95 weight percent of said copolymer.

6. An intermediate transfer member in accordance with claim 1 wherein said polysiloxane is present in an amount of from about 15 to about 50 weight percent of-said polyimide polysiloxane.

7. An intermediate transfer member in accordance with claim 1 wherein said polyimide is at least one of a polyimide, a polyamidimide, and mixtures thereof.

8. An intermediate transfer member in accordance with claim 1 wherein said member has a surface resistivity of from about $10^7$ to about $10^{13}$ ohm/sq.

9. An intermediate transfer member in accordance with claim 8 wherein said surface resistivity is from about $10^9$ to about $10^{11}$ ohm/sq.

10. An intermediate transfer member in accordance with claim 1 wherein said polyaniline is present in an amount of from about 3 to about 25 percent by weight based on the weight of total solids.

11. An intermediate transfer member in accordance with claim 10 with a surface resistivity is from about $10^9$ to about $10^{13}$ ohm/sq.

12. An intermediate transfer member in accordance with claim 1 wherein said release layer is a fluorosilicone, a copolymer, or a terpolymer of vinylidenefluoride, hexafluoropropylene and tetrafluoroethylene, or mixtures thereof.

13. An intermediate transfer member in accordance with claim 1 wherein said adhesive layer is present.

14. An intermediate transfer member in accordance with claim 13 wherein said adhesive layer is of a thickness of from about 1 to about 100 nanometers, and said layer is comprised of an epoxy, a urethane, a silicone, and a polyester, or mixtures thereof.

* * * * *